United States Patent [19]

Anderson et al.

[11] Patent Number: 4,636,906

[45] Date of Patent: Jan. 13, 1987

[54] SOLID STATE CIRCUIT INTERRUPTION EMPLOYING A STORED CHARGE POWER TRANSISTOR

[75] Inventors: Thomas E. Anderson, Highland Heights, Ohio; Edward K. Howell, Simsbury, Conn.

[73] Assignee: General Electric Company, New York, N.Y.

[21] Appl. No.: 726,546

[22] Filed: Apr. 24, 1985

[51] Int. Cl.[4] ..... H01H 9/30

[52] U.S. Cl. ..... 361/13; 361/8; 361/11

[58] Field of Search ..... 361/2, 3, 5, 6, 8, 11, 361/13, 58; 307/134, 135

[56] References Cited

U.S. PATENT DOCUMENTS

| | | | |
|---|---|---|---|
| 3,430,063 | 2/1969 | Webb | 361/13 |
| 3,601,622 | 8/1971 | Waaben | 307/136 |
| 4,300,181 | 11/1981 | Premerlani | 361/8 X |
| 4,420,784 | 12/1983 | Chen et al. | 361/13 X |
| 4,438,472 | 3/1984 | Woodworth | 361/13 |

OTHER PUBLICATIONS

U.S. Patent Application 610,947 filed 5/16/84, title "Solid State Current Limiting Circuit Interrupter" by E. K. Howell.

*Primary Examiner*—A. D. Pellinen
*Assistant Examiner*—Derek S. Jennings
*Attorney, Agent, or Firm*—Richard A. Menelly; Walter C. Bernkopf; Fred Jacob

[57] ABSTRACT

A solid state circuit interrupter utilizes a power transistor connected across a pair of separable contacts to eliminate contact arcing between the contacts upon circuit interruption. Stored charge is provided to the power transistor prior to contact separation by a separate power supply and control transistor which are immediately turned off after contact separation to turn off the power transistor upon depletion of the stored charge.

8 Claims, 3 Drawing Figures

SOLID STATE CIRCUIT INTERRUPTION EMPLOYING A STORED CHARGE POWER TRANSISTOR

BACKGROUND OF THE INVENTION

The use of a semiconductor element across a pair of separating contacts in an electric circuit to eliminate arcing and prevent contact damage is already known. Various circuits have been proposed to turn on the semiconductor prior to contact separation to allow the semiconductor to transfer the circuit current away from the contacts for a sufficient time to allow the contact separation to increase and the contact temperature to decrease to such an extent that arcing is eliminated. Other circuits have been proposed to turn off the semiconductor once the contacts have been separated to prevent the semiconductor element from becoming overheated and damaged by excess circuit current.

U.S. patent application Ser. No. 610,947 filed May 16, 1984 in the name of E.K. Howell describes a voltage dependent element in parallel with a semiconductor element to transfer the circuit current away from the semiconductor. Also disclosed is the arrangement of a capacitor in the base-collector circuit of the semiconductor to turn on the semiconductor and a saturable core current transformer in the base-emitter circuit to turn off the semiconductor and transfer the circuit current to a voltage dependent element. This application is incorporated herein for purposes of reference and should be reviewed for a good description of the relationship between circuit voltage and circuit current during the interruption process.

The use of a capacitor in the base-collector circuit of a bipolar transistor across a pair of contacts to turn on the transistor when the contacts are opened is disclosed within U.S. Pat. No. 4,438,472 in the name of George K. Woodworth. A diode in the base-emitter circuit of the transistor discharges the capacitor when the contacts are closed. It is believed that the use of such a circuit arrangement within residential and industrial power circuits would require too large a capacitor and diode to make such an arrangement commercially feasible.

U.S. Pat. No. 3,601,622 in the name of Sigurd G. Waaben discloses the use of a charge storage diode across a pair of contacts to prevent contact arcing. When the contacts are opened the diode short circuits the contacts to prevent arcing until the charge accumulated in the diode is depleted. The invention is disclosed for use within low power circuits such as an automobile ignition system.

One purpose of the instant invention is to provide an inexpensive and practical means for storing charge in a power transistor connected across a pair of separable contacts so that the transistor turns on when the contacts are separated to transfer current away from the contacts to eliminate arcing. An additional purpose of the invention is to turn off the transistor once the contacts have separated in order to transfer the current to a voltage dependent element thereby interrupting the current without damaging the transistor.

SUMMARY OF THE INVENTION

A power transistor and a control transistor are arranged in circuit relation with a pair of separable contacts within a protected power system. The power transistor is arranged across the contacts to eliminate arcing upon circuit interruption and the control transistor connects a separate power supply to the power transistor to provide stored charge. After the contacts have separated a sufficient distance the power supply is shut off.

GENERAL DESCRIPTION OF THE INVENTION

As described within the aforementioned Howell Patent Application, some means is required for turning on the parallel power transistor as soon as the contacts become separated, maintain conduction for a predetermined time sufficient to allow contact separation, and turn off and maintain the power transistor off whereby the voltage dependent element becomes conductive in order to transfer the circuit current from the transistor to the voltage dependent element. This not only ensures that the circuit energy will be dissipated within and interrupted by the voltage dependent element, but also protects the power transistor from becoming damaged by transient voltage when large fault currents are switched within residential and industrial power systems. The use of a separately switched power supply and a control transistor to provide stored charge to the power transistor allows the power transistor to turn on only for the duration of the stored charge which is then swept away by collector current through the power transistor. The instant the power transistor becomes conductive, the power supply and control transistor are turned-off. The charge storage characteristics of the power transistor are selected to turn off the power transistor within a predetermined time period, after which time the voltage controlled element becomes conductive.

DESCRIPTION OF THE PREFERRED EMBODIMENT

Figure 1:
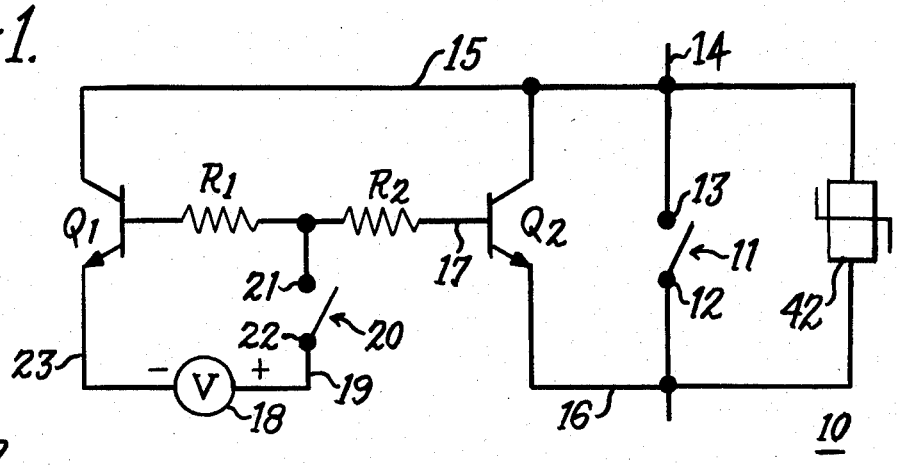
FIG. 1 is a diagrammatic representation of one stored charge circuit used within the circuit interrupter according to the invention within a DC circuit.

A suitable stored charge supply circuit is shown at 10 in FIG. 1 connected to a power bus 14 which contains a controlled switch 11 for connecting and interrupting circuit current through contacts 12, 13. A power transistor $Q_2$ is arranged across the contacts to transfer the circuit current away from the contacts and to allow the contacts to cool to a temperature below thermionic emission and to separate a sufficient distance to prevent the arc from reoccuring as described within the aforementioned Howell Application. When the clamping voltage of the parallel connected voltage controlled silicon carbide or metal oxide varistor 42 is exceeded, the varistor becomes conductive until the system stored energy is dissipated and the system voltage falls below the clamping voltage at which time the current through the varistor rapidly drops to zero. To ensure that the power transistor will turn on the instant that the contacts become separated, a control transistor $Q_1$ is arranged within the base-collector circuit of $Q_2$. The collector of $Q_1$ is connected with the collector of $Q_2$ and to the power bus 14 on one side of switch 11 via conductor 15. The base of $Q_1$ is connected to the base of $Q_2$ through current limiting resistors $R_1$, $R_2$. The emitter of $Q_2$ is connected to the other side of switch 11 by means of conductor 16. To provide operating power to both Q1 and Q2 a DC power supply 18 is connected with the emitter of $Q_1$ through conductor 23 and to $R_1$ and $R_2$ through switch 20 and conductor 19. Since switch 20 only carries base drive current for the transistors, contacts 21, 22 can be quite small compared to the power bus contacts 12, 13. $Q_1$ can also be substantially smaller than $Q_2$ since no circuit current is switched through $Q_1$.

Prior to opening switch 11, and with switch 20 closed, a first circuit path is established from power supply 18 through switch 20 and $R_1$ through the emitter of $Q_1$ back to power supply 18. The base-emitter current through Qeffectively saturates $Q_1$ allowing a second conductive path from power supply 18 through switch 20 through $R_2$ to the base-collector junction of $Q_2$ and conductor 15 and collector-emitter junction of $Q_1$ back to power supply 18, storing charge in the base-collector junctions of both $Q_1$ and $Q_2$. The transport of current through the base and collector of $Q_1$ and $Q_2$ provides sufficient stored charge to maintain conduction in $Q_1$ and $Q_2$ for a predetermined time when switch 11 is opened to interrupt the circuit current. Switch 20 is preferably arranged to open simultaneously with switch 11 to allow the remaining charge within $Q_1$ and $Q_2$ to be swept away by collector current transport to the other side of switch 11 via conductor 16. When it is desired to restore current through bus 14, switches 11 and 20 are closed to again provide $Q_1$ and $Q_2$ with stored charge.

Figure 2:
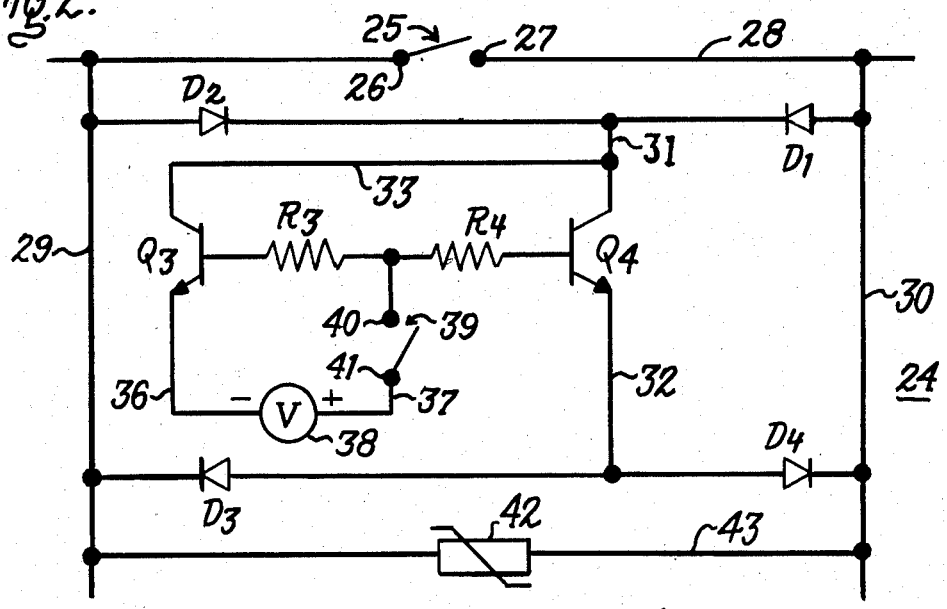
FIG. 2 is a diagrammatic representation of the circuit interrupter of the invention used within an AC circuit.

A complete circuit interrupter 24 is shown in FIG. 2 for an AC circuit wherein a switch 25 controls conduction between contacts 26, 27 through a power bus 28. A bridge rectifier consisting of diodes $D_1$–$D_4$ places DC circuit current through conductors 31 and 32. The base drive to control transistor $Q_3$ is provided from power source 38 over conductor 37 through switch 39 and resistor $R_3$ to the base-emitter of $Q_3$. In the same manner as described earlier with respect to FIG. 1, the contacts 40, 41 within switch 39 are much smaller than the contacts 26, 27 within switch 25 and control transistor $Q_3$ is rated substantially lower than power transistor $Q_4$. The stored charge to $Q_4$ is provided by the transport of current from power supply 38 through switch 39, resistor $R_4$, the base-collector of $Q_4$, back along conductor 33 through the collector-emitter of $Q_3$ to power supply 38 over conductor 36. By proper selection of $R_3$, $R_4$ and the charge storage characteristics of $Q_3$ and $Q_4$, the current transport through $Q_4$, when switches 25, 39 become opened, can be timed to turn off $Q_4$ when switch 25 can safely withstand the voltage across the voltage clamp varistor 42. Turning off the power transistor causes the voltage across the varistor to reach its clamping voltage to immediately transfer the circuit current through conductor 29 and varistor 42 to bus 28 via conductors 43 and 30. The circuit current through the varistor would then rapidly decay to zero to interrupt the circuit as described within the aforementioned Howell Application.

Figure 3:
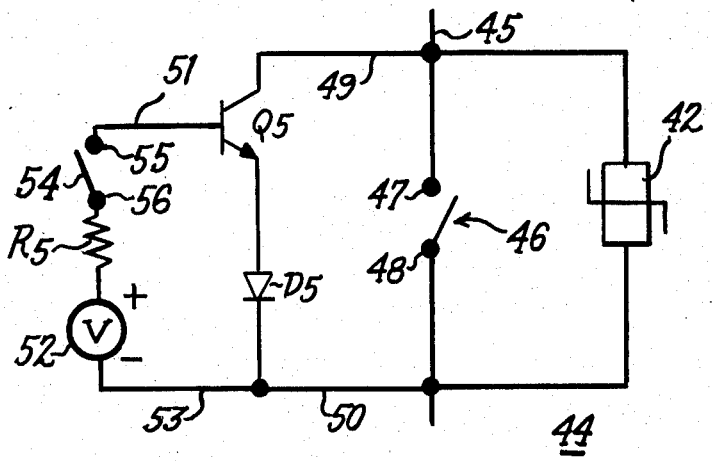
FIG. 3 is a diagrammatic representation of another stored charge circuit used within the circuit interrupter within a DC circuit.

A second circuit arrangement for providing stored charge in DC applications is shown at 44 in FIG. 3. The switch 46 operatively controls conduction through a DC power bus 45 by means of a pair of contacts 47, 48. A power transistor $Q_5$ is connected across the contacts for diverting circuit current away from the separating contacts in the same manner as described earlier with reference to FIGS. 1 and 2. Unlike the earlier embodiments, a control transistor is not required for transporting current through the base-collector of the power transistor $Q_5$ to produce the required stored charge when switches 46 and 54 are closed. A separate power supply 52 produces current through resistor $R_5$, contacts 55, 56 to the base of $Q_5$ over conductor 51, through base-collector of $Q_5$ through conductor 49, contacts 47, 48, and conductors 50, 53 back to the power supply 52. Diode $D_5$ inhibits current from flowing in the base-emitter of $Q_5$ when switch 46 is closed. Switch 54 is preferably opened simultaneously with the opening of switch 46 whereby stored charge in $Q_5$ enables current to transfer from switch 46 through conductor 50 until the stored charge is depleted, whereupon $Q_5$ turns off and current transfers to the voltage dependent element 42 at a voltage substantially higher than power supply voltage, thereby forcing the current to drop rapidly to zero.

It is thus seen that stored charge can be applied to the base-collector junction of a bi-polar transistor arranged across separable contacts in a power bus circuit to allow the transistor to be turned on immediately upon opening of the contacts to interrupt the circuit current. The current through the power transistor quickly depletes the stored charge and allows the transistor to shut off to prevent the transistor from becoming damaged from excessive current.

Having described our invention, what we claim as new and desire to secure by Letters Patent is:

1. A circuit interrupter comprising:

a power transistor connected across a pair of separable contacts within an AC protected circuit for transferring circuit current away from said contacts when said contacts first becomes separated;

power supply means connected to a base on said power transistor through a switch and to a collector on said power transistor through a control transistor for providing stored charge to said power transistor base-collector junction when said switch and said contacts are closed to thereby allow said power transistor to turn on when said contacts and said switch are opened to allow said power transistor to turn off as soon as said stored charge is depleted; and voltage dependent means connected across said power transistor for transferring said circuit current away from said power transistor when said power transistor has turned off.

2. The circuit interrupter of claim 1 wherein said control transistor and said power transistor bases are connected to said power supply through current limiting resistors.

3. The circuit interrupter of claim 1 wherein said power supply means is connected across an emitter and a base on said control transistor for providing base-emitter current through said control transistor to make said control transistor conductive.

4. The circuit interrupter of claim 1 wherein a collector on said control transistor is connected with said power transistor collector for providing a conductive path through said control transistor to said power transistor base and collector for providing said stored charge to said power transistor base-collector junction.

5. A circuit interrupter comprising:

a power transistor connected across a pair of separable contacts through a diode for transferring DC circuit current away from said contacts when said contacts first become separated; and power supply means connected to a base on said power transistor and to one of said separable contacts through a switch for providing base-collector current to said power transistor to supply stored charge to said power transistor base when said separable contacts and said switch are both closed, whereby said power transistor turns on when said switch is opened and said contacts first become separated to transfer said circuit current away from said contacts and whereby said power transistor then turns off by depletion of said stored charge from said power transistor base.

6. The circuit interrupter of claim 5 including a resistor in series with said power supply means to limit said base-collector current through said power transistor.

7. The circuit interrupter of claim 5 wherein said separable contacts and said switch are opened and closed simultaneously.

8. The circuit interrupter of claim 5, including a voltage dependent element across said power transistor for transferring said circuit current away from said power transistor when said power transistor turns off.

* * * * *